US010957505B2

(12) United States Patent
Chen et al.

(10) Patent No.: US 10,957,505 B2
(45) Date of Patent: Mar. 23, 2021

(54) DISCONNECT SWITCH ASSEMBLIES WITH A SHARED ACTUATOR THAT CONCURRENTLY APPLIES MOTIVE FORCES IN OPPOSING DIRECTIONS AND RELATED CIRCUIT BREAKERS AND METHODS

(71) Applicant: Eaton Intelligent Power Limited, Dublin (IE)

(72) Inventors: Steven Zhenghong Chen, Moon Township, PA (US); Mark A. Juds, New Berlin, WI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/836,277

(22) Filed: Mar. 31, 2020

(65) Prior Publication Data

US 2020/0402751 A1 Dec. 24, 2020

Related U.S. Application Data

(60) Provisional application No. 62/863,322, filed on Jun. 19, 2019.

(51) Int. Cl.
*H01H 33/42* (2006.01)
*H01H 33/662* (2006.01)
*H01H 33/666* (2006.01)

(52) U.S. Cl.
CPC ..... *H01H 33/666* (2013.01); *H01H 33/42* (2013.01); *H01H 33/66207* (2013.01)

(58) Field of Classification Search
CPC ..... H01H 33/666; H01H 33/66207; H01H 33/6662; H01H 2033/6665; H01H 31/003; H01H 33/42
(Continued)

(56) References Cited

U.S. PATENT DOCUMENTS 3,597,556 A * 8/1971 Sharp ..... H01H 33/666 218/4
4,087,664 A * 5/1978 Weston ..... H01H 33/143 218/3

(Continued)

OTHER PUBLICATIONS

Bosworth et al. "High Speed Disconnect Switch with Piezoelectric Actuator for Medium Voltage Direct Current Grids" IEEE Electric Ship Technologies Symposium, pp. 419-423 (2015).
Peng et al. "A Fast Mechanical Switch for Medium Voltage Hybrid DC and AC Circuit Breakers" IEEE Transactions on Industry Applications 52(4):2911-2918 (2015).

(Continued)

*Primary Examiner* — William A Bolton
(74) *Attorney, Agent, or Firm* — Myers Bigel, P.A.

(57) ABSTRACT

A disconnect switch assembly includes first and second disconnect switches with each of the first and second disconnect switch including a housing, a fixed main contact in the housing, and a movable main contact in the housing in cooperating alignment with the fixed main contact. Each of the movable main contacts is coupled to a (common) first actuator. A second actuator is coupled to the housing of the first disconnect switch and a third actuator is coupled to the housing of the second disconnect switch. The first actuator is configured to concurrently apply first and second motive forces (in opposing but in-line directions) to the movable contacts of the first and second disconnect switches. The second and third actuators are configured to apply a motive force to the housings that is in a direction opposing a respective motive force applied by the first actuator to the movable main contacts.

24 Claims, 16 Drawing Sheets

(58) Field of Classification Search
USPC ..... 218/4–10, 118
See application file for complete search history.

(56) References Cited

U.S. PATENT DOCUMENTS

| | | | | | |
|---|---|---|---|---|---|
| 4,204,101 | A | * | 5/1980 | Dethlefsen | H01H 33/59 218/118 |
| 4,281,231 | A | * | 7/1981 | Griesen | H01H 33/664 218/123 |
| 4,434,332 | A | * | 2/1984 | Yanabu | H01H 33/143 218/144 |
| 5,905,242 | A | * | 5/1999 | Bernard | H01H 33/6661 218/154 |
| 8,952,826 | B2 | | 2/2015 | Leccia et al. | |
| 2017/0352507 | A1 | * | 12/2017 | Kim | H01H 33/285 |
| 2018/0005784 | A1 | * | 1/2018 | Nagatake | H01H 33/662 |
| 2018/0294115 | A1 | * | 10/2018 | Hwang | H01H 1/50 |
| 2020/0279709 | A1 | | 9/2020 | Chen et al. | |

OTHER PUBLICATIONS

Peng et al. "Evaluation of Design Variables in Thompson Coil based Operating Mechanisms for Ultra-Fast Opening in Hybrid AC and DC Circuit Breakers" IEEE Applied Power Electronics Conference and Exposition, pp. 2325-2332 (2015).

Wu et al. "A New Thomson Coil Actuator: Principle and Analysis" IEEE Transactions on Components, Packaging and Manufacturing Technology 5(11):1644-1654 (2015).

* cited by examiner

DISCONNECT SWITCH ASSEMBLIES WITH A SHARED ACTUATOR THAT CONCURRENTLY APPLIES MOTIVE FORCES IN OPPOSING DIRECTIONS AND RELATED CIRCUIT BREAKERS AND METHODS

RELATED APPLICATIONS

This application claims the benefit of and priority to U.S. Provisional Patent Application Ser. No. 62/863,322, filed Jun. 19, 2019, the content of which is hereby incorporated by reference as if recited in full herein.

FIELD OF THE INVENTION

The present invention relates to circuit interrupters.

BACKGROUND OF THE INVENTION

Circuit interrupters provide protection for electrical systems from electrical fault conditions such as, for example, current overloads, short circuits and abnormal level voltage conditions. Typically, circuit interrupters include a stored energy type operating mechanism which opens electrical contacts to interrupt the current through the conductors of an electrical system in response to abnormal conditions, although a wide range of driving mechanisms may be employed.

Circuit interrupters can be high voltage or low voltage. Referring to FIG. 1, circuit interrupters, such as, for example, power circuit breakers for systems operating above about 1,000 volts, typically utilize a vacuum interrupter (VI) 15 as the switching device but lower rated devices may also use VIs. The circuit interrupters include separable main contacts 16, 17 disposed within an insulating housing 15*h*. Generally, one of the contacts 16 is fixed relative to both the housing 15*h* and to an external electrical conductor which is interconnected with the power circuit associated with the circuit interrupter. The other contact 17 is moveable. In the case of a VI, the moveable contact assembly usually comprises a stem 15*s* of circular cross-section having the contact 17 at one end enclosed within a vacuum chamber 15*c* and an actuator driving mechanism coupled at the other end which is external to the vacuum chamber 15*c*. The actuator driving mechanism provides the motive force to move the moveable contact 17 into or out of engagement with the fixed contact 16. See, e.g., U.S. Pat. No. 8,952,826 to Leccia et al., the contents of which are hereby incorporated by reference as if recited in full herein.

VIs are typically used, for instance, to reliably interrupt medium voltage alternating current (AC) currents and, also, high voltage AC currents of several thousands of amperes or more. Conventionally, one VI is provided for each phase of a multi-phase circuit and the VIs for the several phases are actuated simultaneously by a common operating mechanism, or separately by separate operating mechanisms (and separate auxiliary switches).

Conventional interruption times are on the order of about 30 ms to about 85 ms. There remains a need for disconnect switches that can accommodate high voltages while providing fast opening gap(s) for use with power distribution systems.

SUMMARY OF EMBODIMENTS OF THE INVENTION

Embodiments of the present invention provide circuit interrupters that have ultrafast movement to provide a first small (interruption) opening gap between the fixed and movable contacts, followed by a larger electrical isolation gap.

Embodiments of the invention provide disconnect switch assemblies that are scalable and suitable for high voltage uses while providing fast switching interruption response (speed or acceleration), endurance (switching cycles) and power density (size).

Embodiments of the present invention include disconnect switch assemblies with first and second disconnect switches, both coupled to an actuator residing between the first and second disconnect switches that concurrently applies motive forces in first and second opposing directions to open first and second movable contacts from a respective closed position in spaced apart vacuum chambers of the first and second disconnect switches.

Embodiments of the invention are directed to a disconnect switch assembly. The disconnect switch assembly include: a first disconnect switch with a first housing, a first fixed main contact in the first housing, and a first movable main contact in the first housing in cooperating alignment with the first fixed main contact. The disconnect switch assembly also includes a second disconnect switch with a second housing, a second fixed main contact in the second housing, and a second movable main contact in the second housing in cooperating alignment with the second fixed main contact. The disconnect switch assembly further includes a first actuator coupled to the first movable main contact and to the second movable main contact, a second actuator coupled to the first housing, and a third actuator coupled to the second housing. During an opening operation, the second actuator is configured to apply a motive force to the first housing of the first disconnect switch that is in a direction opposing a motive force applied by the first actuator to the first movable main contact and the third actuator is configured to apply a motive force to the second housing that is in a direction opposing a motive force applied by the first actuator to the second movable main contact.

The first actuator can reside between the first and second housings.

The first actuator can include first and second drive arms that extend in opposing directions. The first drive arm can be coupled to the first movable main contact to thereby couple the first actuator to the first movable main contact and the second drive arm can be coupled to the second movable main contact to thereby couple the first actuator to the second movable main contact.

The first actuator can be a piezoelectric actuator.

The first actuator can be a Thomson coil actuator.

The first housing and the second housing can each have opposing first and second end portions. The second end portions can be in-line (axially aligned) and face each other across the first actuator.

During the opening operation, the first arm can retract away from the second end portion of the first housing and the second arm can concurrently retract away from the second end portion of the second housing to place the first and second movable contacts at a respective initial interruption gap position. During the opening operation, the second actuator can pull the first housing away from the first actuator while the third actuator pulls the second housing away from the first actuator to place the first and second movable contacts at a respective electrical isolation gap position.

The disconnect switch assembly can further include a first vacuum chamber provided by the first housing. The first fixed main contact and the first movable main contact can reside in the first vacuum chamber. The disconnect switch assembly can further include a second vacuum chamber provided by the second housing. The second fixed main contact and the second movable main contact can reside in the second vacuum chamber. A first drive rod can be coupled to the second actuator and can extend into the first end portion of the first housing. A second drive rod can be coupled to the third actuator and can extend into the first end portion of the second housing.

The disconnect switch assembly can further include a first contact spring coupled to the first housing and a second contact spring coupled to the second housing. In operation, during a closed state of the first disconnect switch and the second disconnect switch, the first contact spring can apply a closing force toward the first movable main contact and the second contact spring can apply a closing force toward the second movable main contact.

The first and second disconnect switch can each have a fully open position for an electrical isolation state and a closed position associated with a fully closed state allowing electrical conduction. In the fully open position, the first fixed and first movable main contacts are spaced apart and the second fixed and the second movable main contacts are spaced apart. In the closed position, each of the first and second fixed main contacts abut a corresponding first and second movable main contact. The second actuator can be configured to apply a latching force to latch the first movable main contact and the first fixed main contact together in the closed position and/or apart in the fully open position while the third actuator can be configured to apply a latching force to latch the second movable main contact and the second fixed main contact together in the closed position and/or apart in the fully open position.

The first and second disconnect switch each can have a fully open position for an electrical isolation state and a closed position associated with a fully closed state allowing electrical conduction. In the fully open position, the first fixed main contact and the first movable main contact are spaced apart and the second fixed main contact and the second movable main contact are spaced apart. In the closed position, the first fixed and first movable main contacts abut and the second fixed and second movable main contacts abut. The first actuator can be configured to concurrently apply a latching force to latch both the first movable and the first fixed main contact and the second movable and the second fixed main contact (a) together in the closed position and/or (b) apart in the fully open position.

The disconnect switch assembly can further include a controller in communication with the first actuator, the second actuator and the third actuator, and wherein the controller directs the first actuator to actuate to concurrently apply a motive force to the first and second movable main contacts and direct the second and third actuators to actuate to apply a motive force to the first and second housings in opposing directions during the opening operation.

The disconnect switch assembly can further include: first coupler assembly that directly or indirectly attaches the second actuator to the first housing and a second coupler assembly that directly or indirectly attaches the third actuator to the second housing.

The first and the second coupler assembly can each comprise a respective contact spring chamber that holds a contact spring. The second actuator can include a first coupler attachment member that is configured to compress the contact spring to apply a closing and/or latching force against the first housing in a direction toward the first movable main contact while the third actuator can include a second coupler attachment member that is configured to compress the contact spring to apply a closing and/or latching force against the second housing in a direction toward the second movable main contact.

The first actuator can provide a motive force in opposing first and second directions to move the first and second movable main contacts, respectively, to an initial interruption gap position. Only the second actuator can provide a motive force to the first housing to move the first housing in the second direction opposing the first direction to move the first fixed main contact away from the first movable main contact. Only the third actuator can provide a motive force to the second housing to move the second housing in the first direction opposing the second direction to move the second fixed main contact away from the second movable main contact whereby the first fixed and first movable main contacts and the second fixed and second movable main contacts are spaced apart in an insulation gap position. There is a greater spacing between the first fixed and first movable main contacts and the second fixed and the second movable main contacts in the insulation gap position than in the initial interruption gap position.

During an opening operation, the second actuator can move a first vacuum interrupter body of the first housing away from the first actuator while the third actuator can move a second vacuum interrupter body of the second housing away from the first actuator. The first disconnect switch can have a first gap space between an end of the first vacuum interrupter body facing the second actuator and an adjacent first support member. The second disconnect switch can have a second gap space between an end of the second vacuum interrupter body facing the third actuator and an adjacent second support member. When the first and second disconnect switches are in a fully closed state and in an initial open state, the first and second gap spaces can be greater than when in a fully open state.

The disconnect switch assembly can further include a first support member residing between the first housing and the second actuator and a second support member residing between the second housing and the third actuator. When the first and second disconnect switches are in a fully closed state and an initial open state, a gap space between the first housing and the first support member and between the second housing and the second support member can be less than when in a fully open state. Optionally, when in the fully closed state, the gap space can be in a range of 5-20 mm.

During the opening operation, the first actuator can move the first and second movable main contacts at a first velocity to an initial interruption gap position away from respective first and second fixed main contacts that is in a range of about 1-3 mm. The second actuator can move the first housing at a second velocity and the third actuator can move the second housing at a third velocity. The second velocity and the third velocity can be less than the first velocity for a time sufficient to move a distance that is in a range of about 3 mm-15 mm whereby the first disconnect switch has a first isolation gap between the first fixed and first movable main contacts that can be in a range of about 5 mm-15 mm and the second disconnect switch has a second isolation gap between the second fixed and second movable main contacts that can be in a range of about 5 mm-15 mm.

The first actuator can be configured to apply respective motive forces to concurrently move the first and second movable main contacts away from the first and second fixed main contacts, respectively, to provide the initial interruption gap position in less than 3 ms, optionally in 1 ms or less, then can stop applying the first and second motive forces.

The second actuator can be configured to apply a motive force to move the first housing and the third actuator can be configured to apply a motive force to the second housing to a full opening travel distance in 20-50 ms thereby providing the first and second isolation gaps.

Yet other embodiments are directed to methods of operating a disconnect switch assembly. The methods include providing a disconnect switch assembly that includes a first vacuum interrupter disconnect switch, a second vacuum interrupter disconnect switch and a first drive actuator therebetween. Each of the first and second vacuum interrupter disconnect switches can have a respective vacuum chamber enclosing a fixed contact and a movable contact. The methods further include actuating the first drive actuator to concurrently apply a first motive force in a first direction to the movable contact in the first vacuum interrupter disconnect switch and a second motive force in an opposing second direction to the movable contact in the second vacuum interrupter disconnect switch to thereby move the movable contacts to an initial opening position.

The disconnect switch assembly can further include a second drive actuator coupled to the first vacuum interrupter disconnect switch and a third drive actuator coupled to the second vacuum interrupter disconnect switch. The method can further include, before or concurrently with actuating the first drive actuator to apply the first and second motive forces, directing the second drive actuator to apply a motive force to the first vacuum interrupter disconnect switch in a direction opposing the first motive force applied by the first actuator while directing the third drive actuator to apply a motive force to the second vacuum interrupter disconnect switch in a direction opposing the second motive force applied by the first actuator during an opening operation to thereby define a separation gap between respective fixed and movable contacts.

The methods can further include actuating the first drive actuator to concurrently apply a closing motive force to each of the movable contacts of the first and second vacuum interrupter disconnect switches in opposing closing directions before or concurrently with actuating the second drive actuator and the third drive actuator to establish a closed state of the first and second vacuum interrupter disconnect switches with respective fixed and main contacts abutting each other.

The methods can further include latching the fixed and movable contacts in an open and/or closed position using the second and third actuators.

During an opening operation, the actuating the first drive actuator can be carried out to concurrently pull the movable contact of the first and second vacuum interrupter disconnect switches away from a corresponding fixed contact using the first and second motive forces applied by the first drive actuator to force each movable contact away from the corresponding fixed contact to an initial interruption gap, then the first drive actuator ceases applying any motive force.

The methods can include actuating a second drive actuator and a third drive actuator to apply its respective motive force for a longer duration than the first drive actuator applies the first and second motive forces to move the vacuum chamber enclosing the fixed and movable contacts away from the first drive actuator to increase a separation distance between the movable and fixed contacts from the initial interruption gap and thereby create an insulation gap.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

FIG. 4A illustrates a closed configuration (normal conduction). FIG. 4B illustrates an initial open (interruption) position. FIG. 4C illustrates a fully open (isolation) position.

FIG. 6A illustrates a closed configuration (normal conduction). FIG. 6B illustrates an initial open (interruption) position. FIG. 6C illustrates a fully open (isolation) position.

DETAILED DESCRIPTION OF EMBODIMENTS OF THE INVENTION

Figure 1:
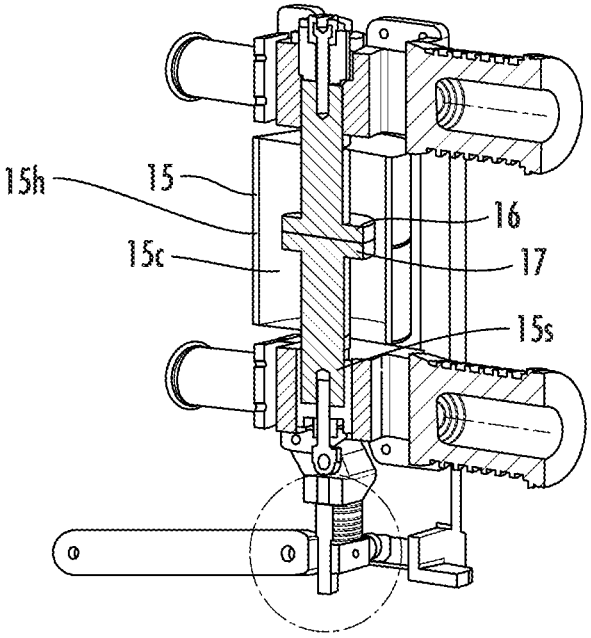
FIG. 1 (PRIOR ART)
FIG. 1 is a partial section schematic view of an example prior art VI.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings.

In addition, the sequence of operations (or steps) is not limited to the order presented in the flowcharts and claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. Broken lines in the flow charts represent optional features or steps.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 2A:
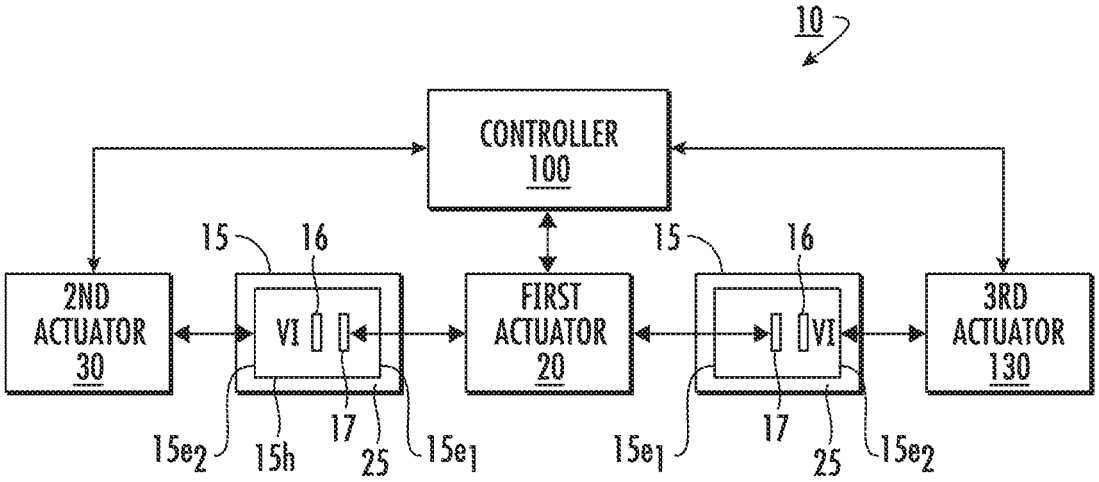
FIG. 2A is a schematic illustration of a circuit of a disconnect switch assembly according to embodiments of the present invention.
Figure 2B:
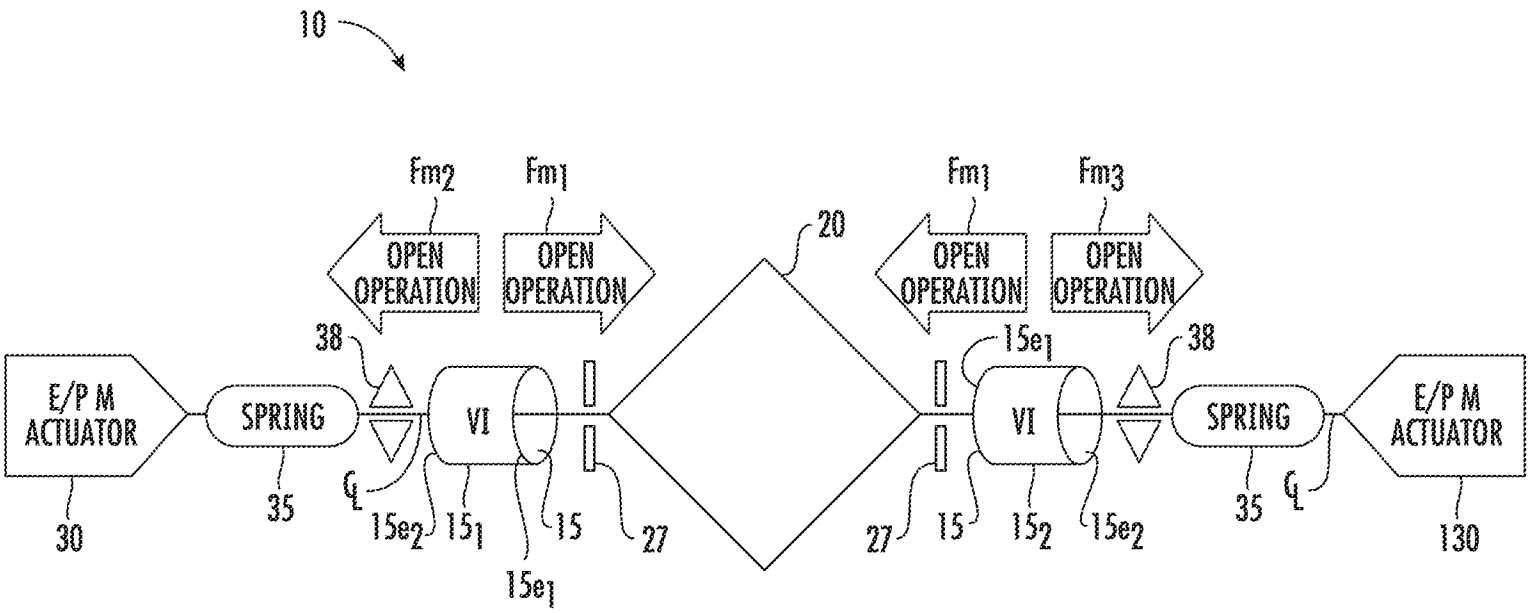
FIG. 2B is a schematic illustration of the disconnect switch assembly shown in FIG. 2A according to embodiments of the present invention.
Figure 9:
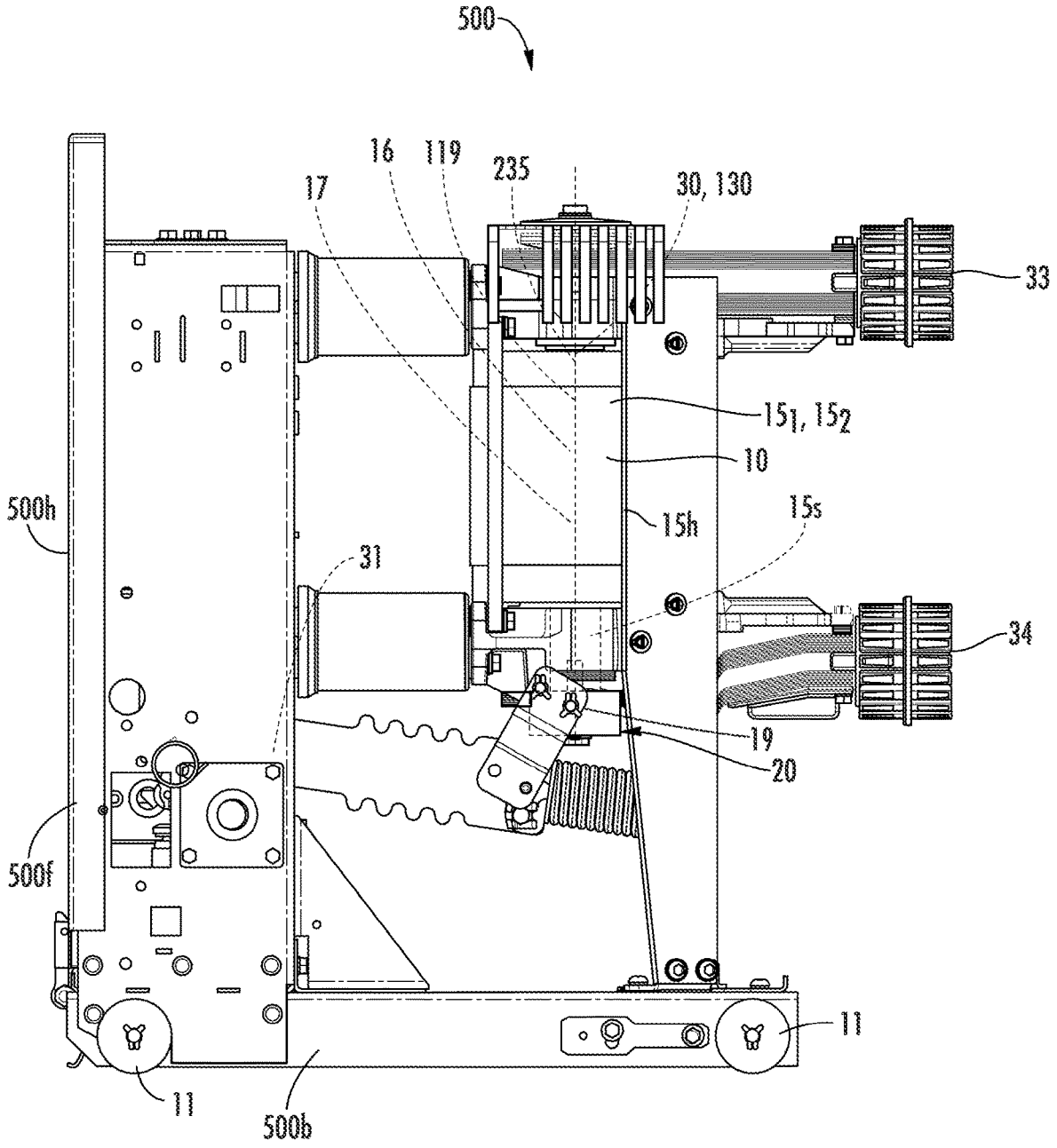
FIG. 9 is an example device comprising a disconnect switch assembly according to embodiments of the present invention.

Referring to FIGS. 2A and 2B, a disconnect switch assembly 10 according to exemplary embodiments is shown. The disconnect switch assembly 10 can be used as a standalone switch or a bypass switch in hybrid circuit breakers for either AC or DC application. FIG. 9 illustrates an example circuit interrupter 500 that comprises one or more of the disconnect switch assemblies 10 according to exemplary embodiments. The circuit interrupter 500 can also be interchangeably referred to as a "circuit breaker".

Still referring to FIGS. 2A and 2B, the disconnect switch assembly 10 comprises a plurality of disconnect switches 15. The disconnect switches 15 can be vacuum interrupters 15. The disconnect switches 15 can include first and second disconnect switches $\mathbf{15}_1$, $\mathbf{15}_2$, which can optionally be configured as vacuum interrupters and each can include a vacuum chamber 15*c* provided by a vacuum chamber housing 15*h*. The vacuum chamber housing 15*h* has axially opposing and spaced apart first and second end portions $\mathbf{15}e_1$, $\mathbf{15}e_2$ held by a VI body 25.

Figure 4A:
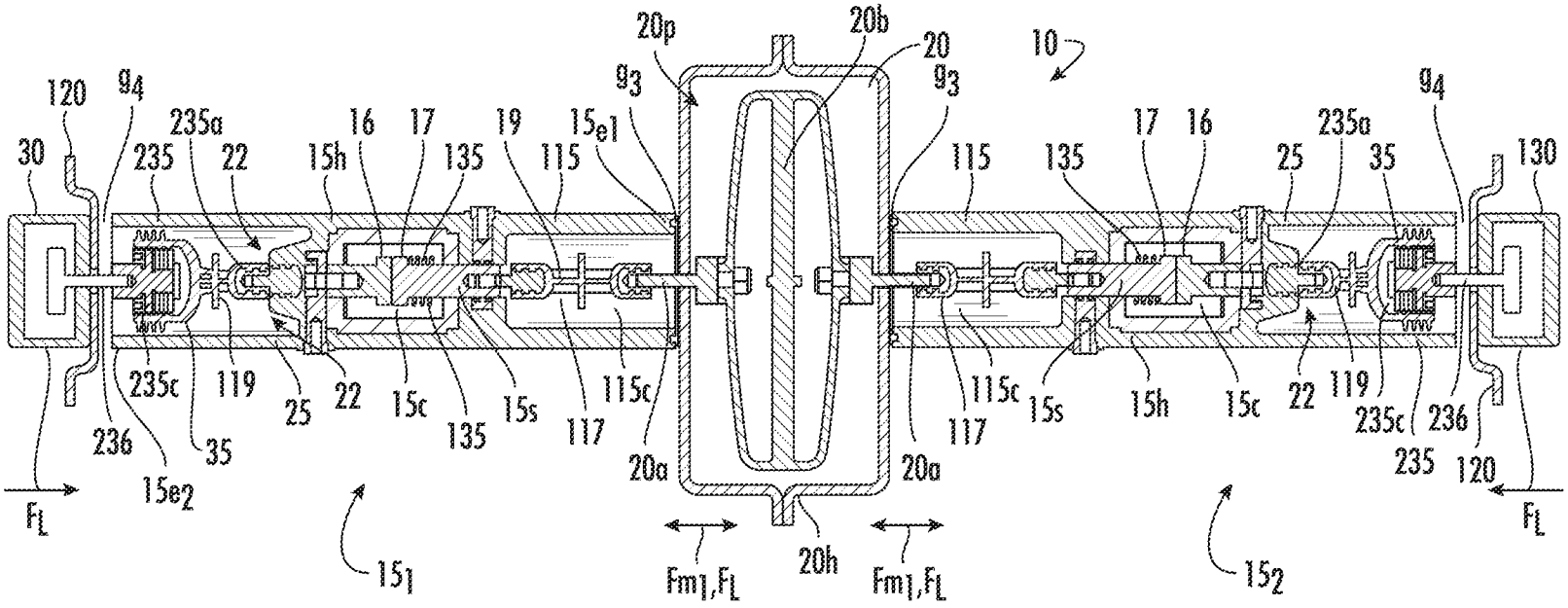
FIGS. 4A-4C are section views of a disconnect switch assembly in three different operational positions according to embodiments of the present invention.
Figure 6A:
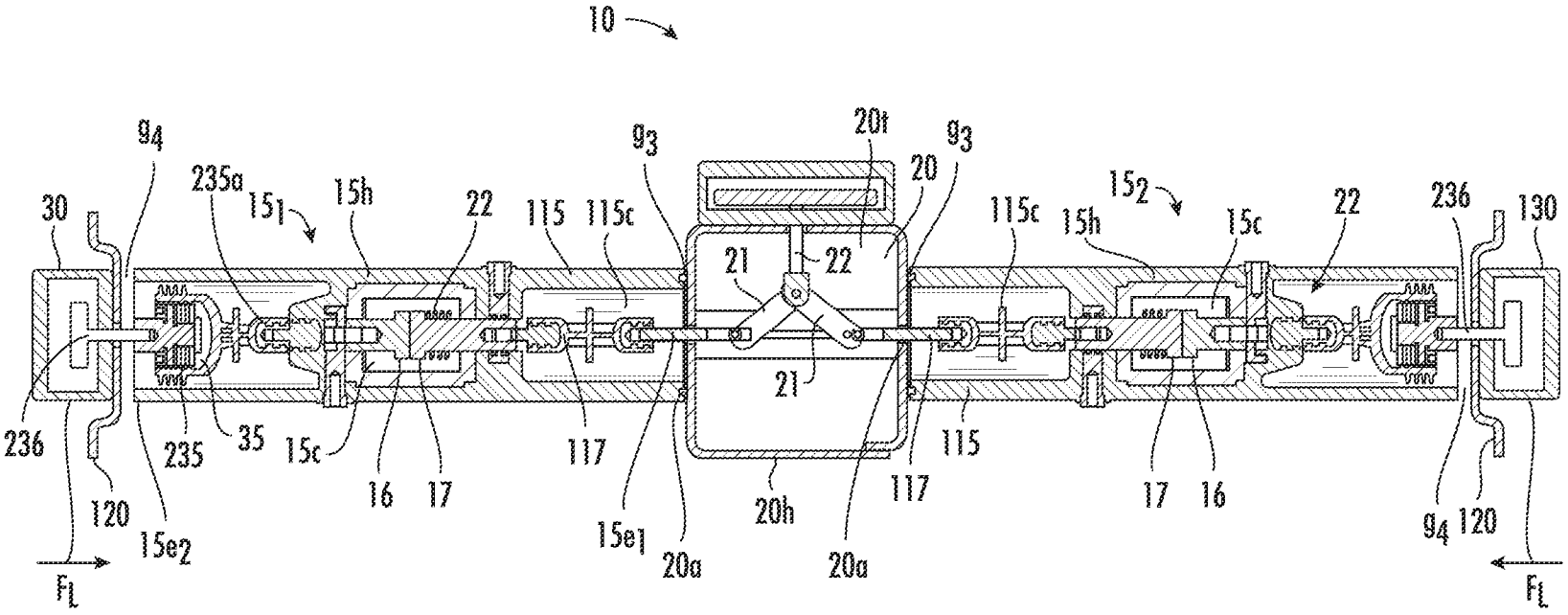
FIGS. 6A-6C are section views of a disconnect switch assembly shown in FIG. 5 in three different operational positions according to embodiments of the present invention.

As shown in FIGS. 2A, 4A and 6A, the main stationary contact 16 and the main movable contact 17 can reside in the vacuum chamber 15*c*.

The disconnect switch assembly 10 includes a first actuator 20 coupled directly or indirectly to the movable contact 17 of both the first and second disconnect switches $\mathbf{15}_1$, $\mathbf{15}_2$. The disconnect switch assembly 10 also includes a second actuator 30 coupled to the first disconnect switch $\mathbf{15}_1$ and a third actuator 130 coupled to the second disconnect switch $\mathbf{15}_2$. The second and third actuators 30, 130 can be coupled to a respective end portion $\mathbf{15}e_2$ of a vacuum chamber housing 15*h* at a location opposing the first actuator 20.

Referring to FIG. 2B, the first actuator 20 can be configured to concurrently provide a motive force $Fm_1$ to each movable contact 17 of the first and second disconnect switches $\mathbf{15}_1$, $\mathbf{15}_2$ to drive one moveable contact 17 in a first direction and another one moveable contact 17 in a second opposing direction for an opening operation (in a direction away from the fixed contact 16). For a closing operation, the first actuator 20 can provide a motive force $Fm_1$ to move a respective movable contact 17 toward a corresponding fixed, stationary contact 16.

During an opening operation, the second actuator 30 can apply a motive force $Fm_2$ and the third actuator 130 can apply a motive force $Fm_3$, both in an opposing direction of the motive force $Fm_1$ applied by the first actuator 20 for an opening operation.

The second actuator 30 and the third actuator 130 can be configured to provide opening and closing operations with a respective motive force $Fm_2$, $Fm_3$ in a first direction for opening and in an opposing second direction for closing, opposite the driving direction of the motive force $Fm_1$ applied by the first actuator 20 for a respective opening and closing operation.

The motive force $Fm_1$ applied by the first actuator 20 can be different than the motive force $Fm_2$ applied by the second actuator 30 and the motive force $Fm_3$ applied by the third actuator 130. In some embodiments, $Fm_1>Fm_2$ and $Fm_1>Fm_3$. In some embodiments, $Fm_2$ is about the same as $Fm_3$.

As shown in FIG. 2A, the disconnect switch assembly 10 can also include a controller 100 that can communicate with the first, second and third actuators 20, 30, 130, respectively.

Figure 4B:
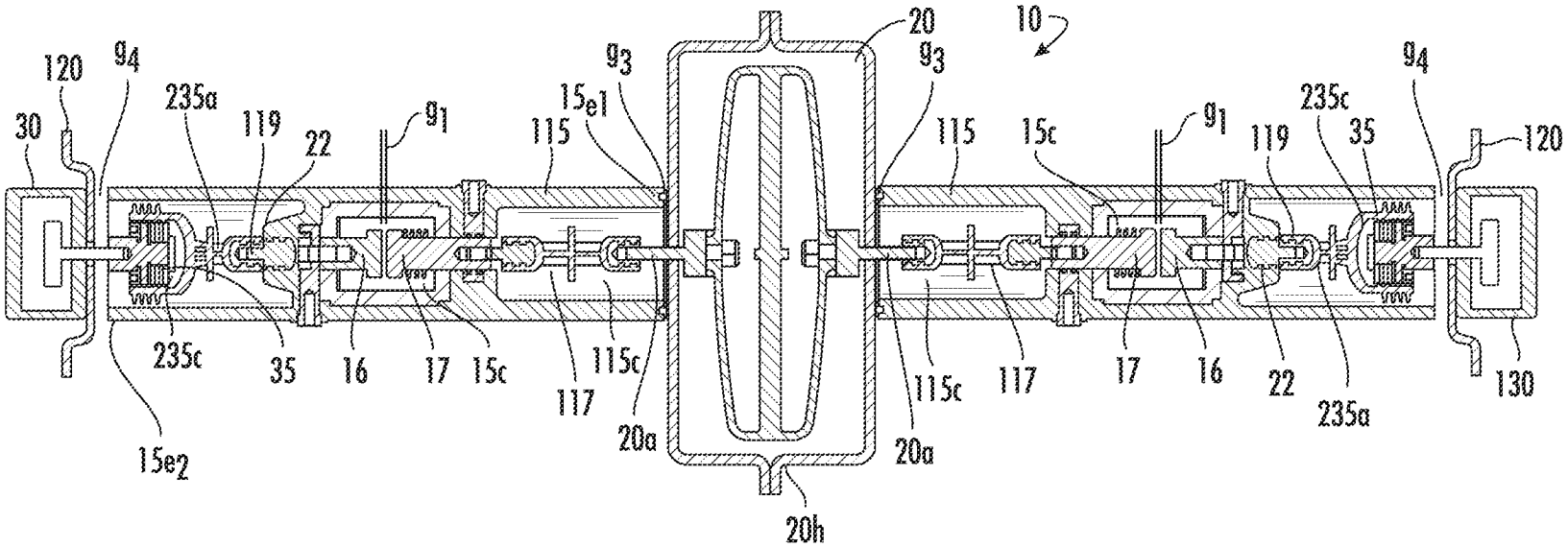
Figure 4C:
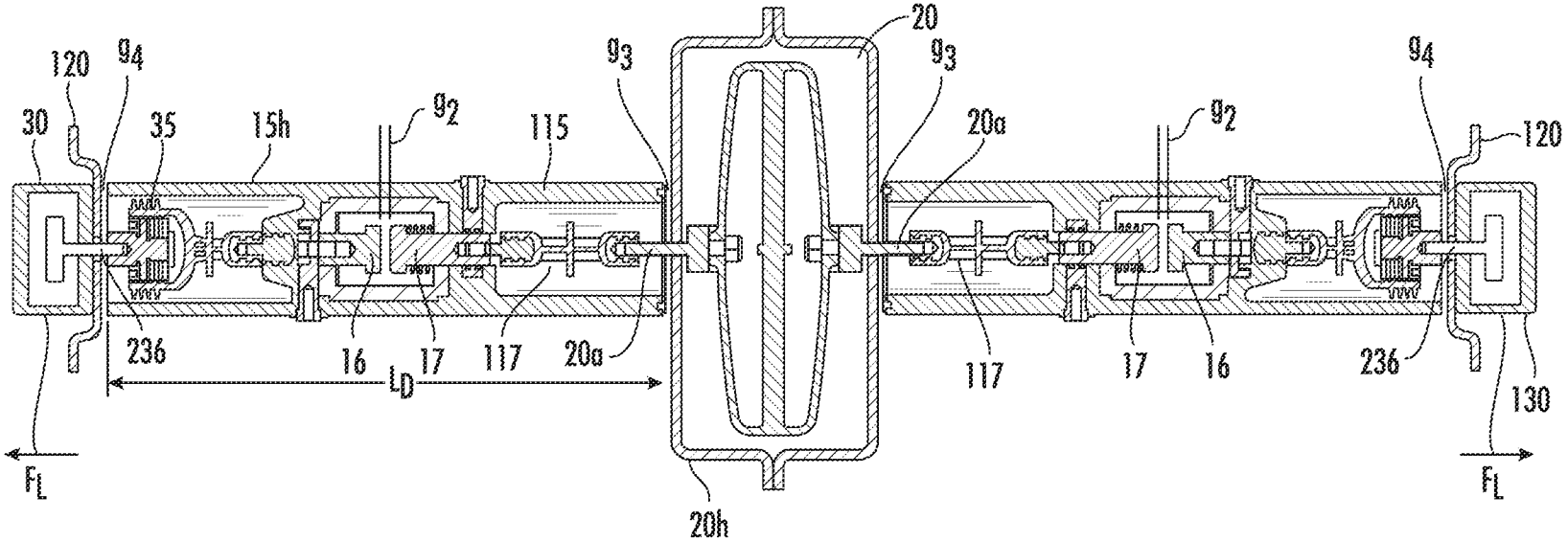
Figure 5:
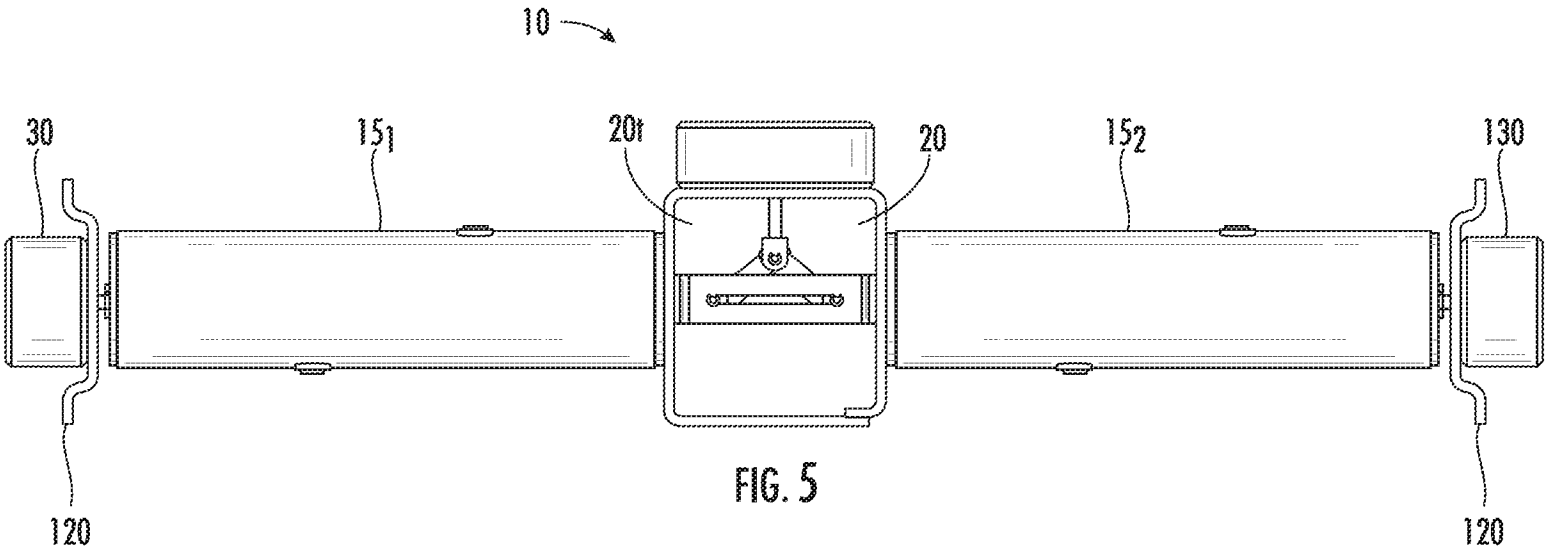
FIG. 5 is a side or top view of a disconnect switch assembly with another embodiment of the first actuator which is shown schematically according to embodiments of the present invention.
Figure 6B:
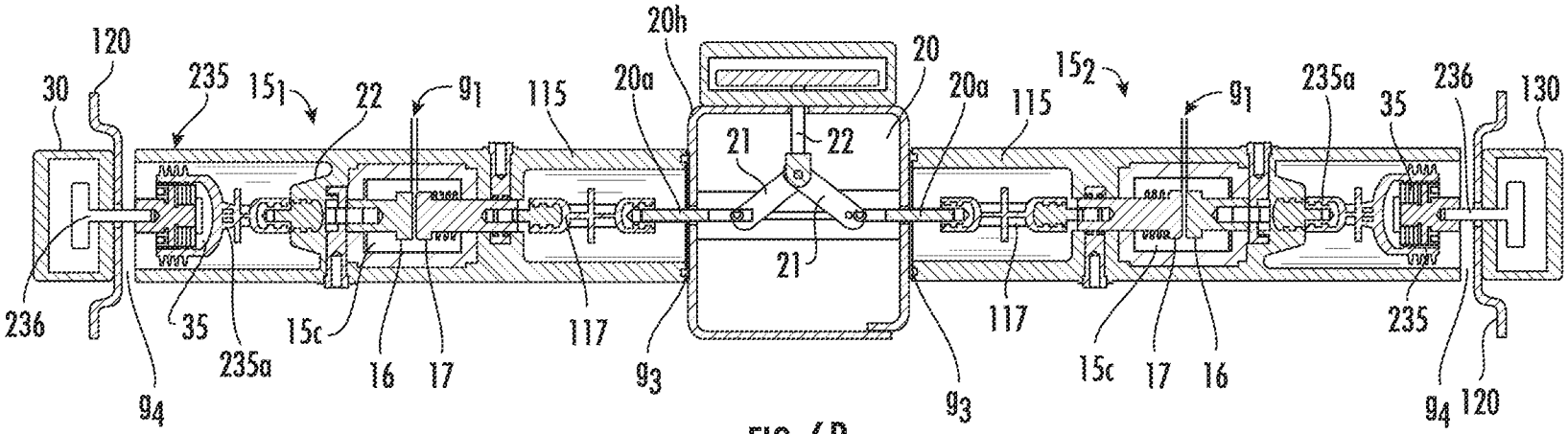
Figure 6C:
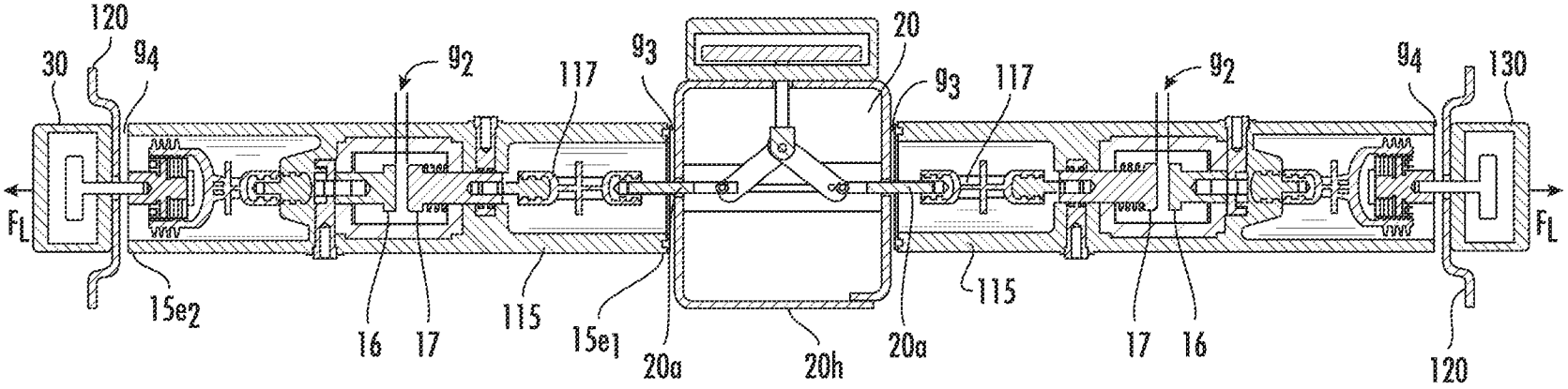

During an opening operation, the controller 100 can direct the first actuator 20 to actuate first to provide the motive forces $Fm_1$ to the movable contacts 17 of each of the first and second vacuum interrupters 15 to move the contacts 17 to a first interrupting position to provide a spaced apart gap, $g_1$, between each of respective fixed main contact 16 and the corresponding moveable contact 17 (FIGS. 4B, 6B) from a closed position (FIGS. 4A, 6A), then direct the second and third actuators 30, 130 to actuate to provide respective motive forces $Fm_2$, $Fm_3$ to further separate the fixed and movable contacts 16, 17 to the isolation position to provide a spaced apart gap, $g_2$, between each of respective fixed main contact 16 and the corresponding moveable contact 17 (FIGS. 4C, 6C).

The controller 100 can direct the first, second and third second actuators 20, 30, 130 to serially or concurrently close during a closing operation.

The second and third actuators 30, 130 can concurrently apply a respective motive force during an opening operation. The first actuator 20 can apply respective motive forces during an opening operation in opposing directions and before or while the second and third actuators 30, 130 apply respective motive forces.

Referring to FIG. 2B, the first actuator 20 resides between two in-line disconnect switches $\mathbf{15}_1$, $\mathbf{15}_2$. The first and second disconnect switches $\mathbf{15}_1$, $\mathbf{15}_2$ can be axially aligned with a common axially extending centerline C/L extending through both disconnect switches $\mathbf{15}_1$, $\mathbf{15}_2$.

Scalability can be an important criterion for certain end uses/applications which can predicate the design's viability in application and production. However, this criterion can pose extreme challenges to desired ultrafast HV (High Voltage) switch and breaker designs because scaling-up often implies a mass increase that will generate negative impact on contact acceleration to achieve fast switching or interruption.

Embodiments of the present invention can scale-up to achieve higher voltage applications over known conventional designs without sacrificing switching speed. A conventional basic unit can have a rated voltage U=U1 while a scaled-up design can provide a rated voltage U=2×U1 (double that of the conventional basic unit).

The first actuator 20 can reside adjacent the first end portions $\mathbf{15}e_1$ of each respective vacuum chamber housing 15*h* (closer to the movable contact 17 than the stationary main contact 16). The two disconnect switches $\mathbf{15}_1$, $\mathbf{15}_2$ (e.g., vacuum interrupters) are driven from both end portions $\mathbf{15}e_1$, $\mathbf{15}e_2$. Opening speed can be distributed along a stroke distance of the main contacts 16, 17 with high acceleration applying only where needed, at the beginning of opening to move to the initial gap space $g_1$ (FIG. 4B, 6B) from the closed position (FIG. 4A, 6A).

Figure 3:
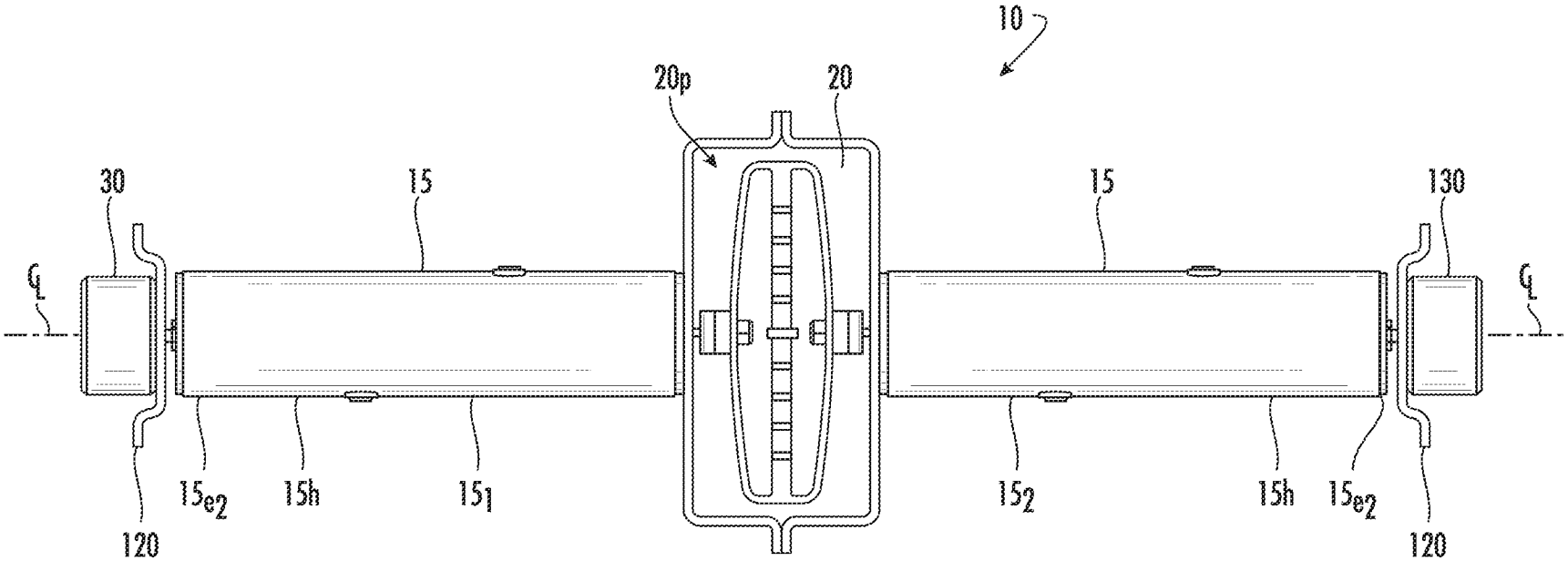
FIG. 3 is a side or top view of a disconnect switch assembly with the first actuator shown schematically according to embodiments of the present invention.

Referring to FIG. 3, motive force $Fm_2$ applied by the second actuator 30 and motive force $Fm_3$ applied by the second actuator 130 can each be applied from a second end portion $\mathbf{15}e_2$ of a respective disconnect switch 15. The disconnect switches $\mathbf{15}_1$, $\mathbf{15}_2$ can be oriented to be in line with each other (axially extending centerlines aligned) with the respective second end portions $\mathbf{15}e_2$ facing each other across the first actuator 20.

As shown in FIGS. 4A, 6A, for example, the second end portion $\mathbf{15}e_2$ of a respective disconnect switch 15 can be defined by a housing 15*h* that fixably holds the fixed main contact 16 in a fixed location in the housing 15*h* and the second end portion $\mathbf{15}e_2$ is axially spaced apart from the first end portion $\mathbf{15}e_1$ of the disconnect switch 15 and resides further away from the first actuator 20 than the first end portion $\mathbf{15}e_1$.

The second end portion $\mathbf{15}e_2$ and can move in concert with the fixed contact 16 in a direction away from the movable contact 17 to move to an electrical isolation (or interruption) position (FIG. 4B, 6B) during an opening stroke cycle.

The second actuator 30 and the third actuator 130 can also be configured to perform a latching operation to apply a latch force $F_L$ to latch the contacts 16, 17 (a) closed for normal operation (FIGS. 4A, 6A) or (b) open when in an open state (FIGS. 4C, 6C). The second actuator 30 and/or the third actuator 130 can be configured to perform a damping operation during movement of the movable contact 17 of the disconnect switch 15.

Thus, the second and third actuators 30, 130 can also provide one or more of closing, latching and damping. The closing and latching provided by the second actuator 30 can be applied concurrently to the first disconnect switch $\mathbf{15}_1$, and in an opposing direction, as the closing and latching of the third actuator 130 to the second disconnect switch $\mathbf{15}_2$.

Although shown as a single first actuator 20, a single second actuator 30, and a single third actuator 130, a plurality of first actuators may be used, a plurality of second actuators may be used and/or a plurality of third actuators may be used (not shown).

As shown in FIG. 2B, the disconnect switch assembly 10 can comprise close position locators 27 to stabilize the disconnect switch 15 during an opening operation to assist in a rapid or quick establishment of the initial interruption gap $g_1$ (FIGS. 4B, 6B). The close position locator 27 can be held or coupled to a support member 120 (FIGS. 3, 4A-4C, 5 and 6A-6C), which can comprise one or more layers of shock absorption material, such as rubber, on a more rigid substrate to provide a suitable support structure.

Referring to FIGS. 4A-4C and 6A-6C, embodiments of the invention can configure both the movable contact 17 and the whole pole unit body 22 (FIG. 4) to move in opposing directions during an opening operation, and typically also during a closing operation. The whole (encapsulated) pole unit body 22 can sit on and/or at a definite position provided by the locator 27 when the switch in its closed status. The locator 27 can provide a suitably reasonable soft landing for the whole pole unit 22 during closing operation but a suitably reasonable stiff support during at least initial opening operation occurring by motive force $Fm_1$ from only the first actuator 20.

Referring to FIGS. 4A, 4B and 6A, 6B, the first actuator 20 can force the movable contact 17 to move to an initial interruption gap $g_1$ (FIGS. 4B, 6B) away from the fixed contact 16 relative to the closed position where the movable contact 17 abuts the fixed contact 16 (FIG. 4A, 6A). The second actuator 30 can move the housing 15*h* with the fixed contact 16 of the first disconnect switch $\mathbf{15}_1$ in a direction opposing the opening direction of the movable contact 17 to a position defining an insulation or isolation gap $g_2$ (FIGS. 4C, 6C). The third actuator 130 can move the housing 15*h* with the fixed contact 16 of the second disconnect switch $\mathbf{15}_2$ in a direction opposing the opening direction of the movable contact 17 to a position defining an insulation or isolation gap $g_2$ (FIGS. 4C, 6C). Typically, the second and third actuators 30, 130 are synched so that the motive forces $Fm_2$, $Fm_3$ are applied concurrently and in opposing directions (FIG. 2B).

Referring to FIG. 2A, FIGS. 4A-4C and 6A-6C, the disconnect switch assembly 10 can include a contact spring 35 between the second and third actuators 30, 130 and a respective disconnect switch 15 that is configured to push axially from the fixed contact direction axially toward the movable contact 17, when the contacts 16, 17 are in a closed position to provide a desired contact force at the closed position (FIGS. 4A, 6A). FIGS. 4A-4C and 6A-6C also illustrate that a bellows 135 can be coupled to the movable contact 17 as conventional.

Referring to FIGS. 4A-4C and 6A-6C, each disconnect switch 15 of the disconnect switch assembly 10 can have a primary VI body 25 that houses the vacuum chamber 15*c* and includes an encapsulated pole unit 22. The second actuator 30 and the third actuator 130 can each be configured to pull a respective VI body 25 from a VI fixed end $\mathbf{15}e_2$ to establish the isolation status position/gap space $g_2$ to withstand short-time and lightning impulse voltages and this results in the VI body 25 and the stationary/fixed primary contact 16 moving away from the moveable primary contact 17. The second actuator 30 and the third actuator 130 can be coupled directly or indirectly to the respective disconnect switch 15, disconnect switch housing 15*h* and/or VI body 25.

As shown in FIG. 4A, for example, the second actuator 30 and the third actuator 130 each comprises a coupler assembly 235 that has an inner facing arm 235*a* that is coupled to the encapsulated pole unit 22. As also shown, the coupler assembly 235 has a chamber 235*c* that holds the contact spring 35 and an actuator attachment member 236. The actuator attachment member 236 can be coupled to the inner arm 235*a*. The actuator attachment member 236 can be attached to the chamber 235*c* on a side away from the innermost arm 235*a*. The arm 235*a* can comprise or be an electrically insulated drive rod 119 that is encased in epoxy adjacent the vacuum chamber housing 15*h* and/or at the pole unit 22. The actuator attachment member 236 can be axially aligned with the arm 235*a*. However, other coupler assemblies may be used. For example, an external sleeve (not shown) can be attached to the end portion of the VI body 25 and used with the coupler assembly shown or used to attach the coupler attachment member 236 to the VI body 25 without the contact spring chamber 235*c* and/or inner arm 235*a* (not shown).

As also shown in FIG. 4A, for example, the first disconnect switch $\mathbf{15}_1$ and the second disconnect switch $\mathbf{15}_2$ can each also include a housing segment 115 facing the first actuator 20 that is spaced apart but adjacent the vacuum chamber 15*c*. The housing segment 115 can have a chamber 115*c* that encloses a drive assembly 117 coupled to the movable main contact 17. The drive assembly 117 can also be coupled to the first actuator 20. The first actuator 20 can include opposing first and second drive arms 20*a* that are coupled to the drive assembly 117 of the movable main contact 17.

Still referring to FIG. 4A, the first actuator 20 can have a pair of in-line and axially spaced apart arms 20*a* that are coupled to and extend from a piezoelectric actuator body 20*b* and that can extend and retract relative to the housing 20*h* to provide the motive force $Fm_1$.

Referring to FIG. 6A, the first actuator 20 can include a linkage with link members 21 that pivot relative to an input link 22 at one end portion and that pivot relative to the arms 20*a* coupled to the second end portion to provide the motive force $Fm_1$.

The disconnect switch assembly 10 can also include a support member 120 for the second actuator 30 and a support member 120 for the third actuator 130. The support members 120 can be stationary and coupled to a housing holding and/or enclosing the disconnect switch assembly 10, such as an internal wall or mounting feature of a cabinet housing 500*h* of a power assembly such as a circuit breaker 500, 500' (FIGS. 9, 10A-10C).

Referring to FIG. 4C, the housing 15*h* of each disconnect switch $\mathbf{15}_1$, $\mathbf{15}_2$ can have an overall length L that includes the housing segment 115 that is fixed. The movable contact drive assembly 117 can extend and retract relative to the first end portion $\mathbf{15}e_1$ of the housing 15*h*, i.e., relative to the housing segment 115. The actuator attachment member 236 can have a fixed (non-extendable/retractable) configuration relative to the second end portion $\mathbf{15}e_2$ of the housing 15*h* but may allow some small (in some particular embodiments, by way of example only, in a range of about 1 mm-3 mm, but other smaller or larger distances may be used) axial movement based on the compression of spring 35. The actuator attachment member 236 can pull (during opening) and push (during closing) the housing 15*h* away from and toward, respectively, the first actuator 20. The actuator attachment member 236 can pull (during opening) and push (during closing) the housing 15*h* toward and away from, respectively, a support member 120. The fixed main contact 16 remains stationary inside the vacuum chamber 15*c* during opening and closing operations.

The first actuator 20 can also include a housing 20*h* that allows the arms 20*a* to extend and retract relative thereto, in opposing directions, to provide the respective motive force $Fm_1$ to open and close the contacts 16, 17 and/or to apply a latching force $F_L$ in either a closed or open position or a closed and open position. The first actuator 20 may also be configured to apply a damping force, which is smaller than the motive force $Fm_1$ applied during opening, to offset the motive force $Fm_2$, $Fm_3$ applied by the second and third actuators 30, 130 during a closing operation.

Referring again to FIG. 2B, as shown, the disconnect switch assembly 10 can include a mass 38 between the second and third actuators 30, 130 and a respective disconnect switch 15 that can be configured to stabilize the housing 15*h* and/or primary VI body 25 during opening operation to assist with a quick establishment of the initial interruption gap $g_1$. A first mass 38 can reside between the second actuator 30 and adjacent disconnect switch $\mathbf{15}_1$ and a second mass 38 can reside between the third actuator 130 and the adjacent disconnect switch $\mathbf{15}_2$. Each mass 38 can be adjustable in position relative to the first actuator 20 and/or a respective second or third actuator 30, 130 and/or second end portion $\mathbf{15}e_2$ of the disconnect switch 15 and/or adjustable in weight or movement characteristics.

The second actuator 30 and the third actuator 130 can be configured to move a greater mass than the first actuator 20. The second actuator 30 can provide a motive force $Fm_2$ and the third actuator 130 can provide a motive force $Fm_3$ resulting in a slower velocity provided by the motive force $Fm_1$ of the first actuator 20.

Embodiments of the invention can provide motive force(s) to move the movable contact 17 of the first and second disconnect switches $\mathbf{15}_1$, $\mathbf{15}_2$, typically concurrently, at a fast velocity from a closed position to the initial interruption gap $g_1$ (FIGS. 4B, 6B) followed by a slower velocity provided by the second actuator 30 and the third actuator 130 to a respective disconnect switch $\mathbf{15}_1$, $\mathbf{15}_2$, and in an opposing direction from the first actuator 20, to provide the isolation position $g_2$ (FIG. 4C, FIG. 6C).

The first actuator 20 can have a different configuration than the second actuator 30 and the third actuator 130 and can provide a motive force $Fm_1$ to move the movable contact 17 to the initial interruption gap position $g_1$, after which the first actuator 20 may stop providing its motive opening force $Fm_1$. The first actuator 20 can be a piezoelectric actuator 20*p* (FIGS. 3, 4A-4C) or a Thomson coil actuator 20*t* (FIGS. 5, 6A-6C). The first actuator 20 is a shared actuator for the first and second disconnect switches $\mathbf{15}_1$, $\mathbf{15}_2$ to provide fast acceleration to the movable contacts 17 for moving to a respective initial opening gap $g_2$ (FIGS. 4B, 6B). Other types of actuators can be used, alone or in combination. The first actuator 20 can be any type of actuators that are fast enough to establish the initial interruption gap $g_1$ in a suitable velocity. Examples, include, but are not limited to, electromagnetic, solenoid, motor, permanent magnet, pneumatic, hydraulic, electro-rheological, magneto-rheological, magnetostriction, linear or rotary versions of these. For a discussion of Thompson coil designs, see, e.g., Peng et al., Evaluation of Design Variables in Thompson Coil based Operating Mechanisms for Ultra-Fast Opening in Hybrid AC and DC Circuit Breakers, *IEEE Applied Power Electronics Conference and Exposition*, pages 2325-2332 (2015); Peng et al., A Fast Mechanical Switch for Medium Voltage Hybrid DC and AC Circuit Breakers, *IEEE Transactions on Industry Applications* 52(4):2911-2918 (2015); Wu et al., A New Thomson Coil Actuator: Principle and Analysis, *IEEE Transactions on Components, Packaging and Manufacturing Technology* 5(11): 1644-1654 (2015). For a discussion of a piezoelectric actuator, see, e.g., Bosworth et al., High Speed Disconnect Switch with Piezoelectric Actuator for Medium Voltage Direct Current Grids, *IEEE Electric Ship Technologies Symposium*, pages 419-423 (2015). The contents of these documents are hereby incorporated by reference as if recited in full herein.

The second actuator 30 and the third actuator 130 can comprise, for example, an electromagnetic actuator, a solenoid type actuator, a rheostat type actuator, a pneumatic actuator, a spring actuator, a motor actuator or a hydraulic actuator. Other types of actuators can be used. The second actuator 30 and/or the third actuator 130 can be a single actuator or a single type of actuator or a plurality of cooperating actuators of the same type or of different types. The second actuator 30 can have the same configuration as the third actuator 130.

In some embodiments, $g_1$ (FIGS. 4B, 6B) is a range of 1 mm and 5 mm, more typically in a range of about 1 mm and about 3 mm. The first actuator 20 can provide the $g_1$ spacing in less than or equal to about 3 ms, such as 3 ms, 2.5 ms, 2 ms, 1.5 ms, 1 ms, and 0.5 ms or even less. The first actuator 20 can provide the only motive force to, typically concurrently, move the movable contact 17 of both disconnect switches $\mathbf{15}_1$, $\mathbf{15}_2$ to the initial separation gap, $g_1$, in less than 3 ms.

In some embodiments, the isolation position has a gap, $g_2$ (FIGS. 4C, 6C), that is in a range of 5-15 mm, such as 5 mm, 6 mm, 7 mm, 8 mm, 9 mm, 10 mm, 11 mm, 12 mm, 13 mm, 14 mm and 15 mm. To be clear, $g_2=g_1+D$, where "D" is the distance the housing 15*h* and/or VI body 25 moves.

The second actuator 30 and the third actuator 130 can move the housing 15*h* and/or VI body 25 a distance D that is in a range of 3-15 mm, more typically a range of 4-8 mm, in a direction opposite the first actuator 20, typically in a time period of 10-85 ms, more typically in a time period of 20-50 ms, 20-40 ms, or 20-30 ms.

The speed to close the contacts 16, 17 is typically of no urgency and each of the first, second and third actuators 20, 30, 130 can serially or concurrently cooperate to close the contacts 16, 17 to the closed position (FIGS. 4C, 6C).

As discussed above, during an opening event, a controller 100 (FIG. 2) can direct the first actuator 20 to actuate and direct the second actuator 30 and the third actuator 130 to actuate, typically concurrently. The first actuator 20 can be configured to move the movable contact 17 at a first velocity. The second actuator 30 and the third actuator 130 can be configured to move a respective housing 15*h* and/or VI body 25 at a slower velocity relative to the first velocity of the movable contact 17 provided by the first actuator 20.

During the opening event, the first actuator 20 and the second and third actuators 30, 130 can operate sequentially or concurrently. The first actuator 20 can apply a respective motive force $Fm_1$ serially or concurrently with the motive forces $Fm_2$, $Fm_3$ provided by the second and third actuators 30, 130. The first actuator 20 can stop applying a motive force, once the initial interruption gap $g_1$ (FIG. 4B, 6B) is achieved and/or prior to the second actuator 30 and/or third actuator 130 applying its motive force $Fm_2$, $Fm_3$, respectively, during an opening event.

Referring to FIG. 4A, the movable main contact 17 can comprise an elongate, typically cylindrical, segment that forms a stem 15*s*. Where a vacuum chamber 15*c* is used, the stem 15*s* extends outside the vacuum chamber 15*c* and is coupled to an electrically insulated drive rod 19 at a location outside the vacuum chamber 15*c*, spaced apart from the movable contact 17.

The second end portion $\mathbf{15}e_2$ of the vacuum interrupter 15 can reside adjacent an encapsulated pole unit 22. The second end portion $\mathbf{15}e_2$ of the vacuum interrupter 15 can be coupled to an electrically insulated drive rod 119 that can define or form the arm 235*a* of the coupler assembly 235.

The second actuator 30 and the third actuator 130 can move the VI body 25 away from the first actuator 20 and provide a gap space $g_3$ (FIG. 4C, 6C) between the housing 15*h* and the housing 20*h* of the first actuator 20. The gap space $g_3$ is greater when in a fully open state (FIGS. 4C, 6C) than in the closed (FIGS. 4A, 6A) or initial, partially open state (FIGS. 4B, 6B).

When in the fully closed state (FIGS. 4A, 6A) or the initial, partially open state (FIGS. 4B, 6B), there can be a gap space $g_4$ between the support member 120 and the adjacent end $\mathbf{15}e_2$ of the housing 15*h* (e.g., VI body 25) that is greater than that same gap space g4 when in the fully open state (FIGS. 4C, 6C).

In some embodiments, $g_4>g_3$ when the disconnect switch 15 is in the fully closed state and $g_4<g_3$ in the fully open state. In some embodiments, in the fully closed state, $g_4$ is in a range of 5-20 mm and in the fully open state, $g_3$ is in a range of 4-19 mm.

As shown in FIG. 9, the disconnect switch assembly 10 can be held in a circuit interrupter 500 that also includes an upper terminal 33 and a lower terminal 34 (typically three parallel and laterally spaced apart upper and lower terminals for a three pole circuit interrupter). The circuit interrupter 500 includes a cabinet or main housing 500*h* and can include a base 500*b*, optionally comprising wheels 11.

Figure 10A:
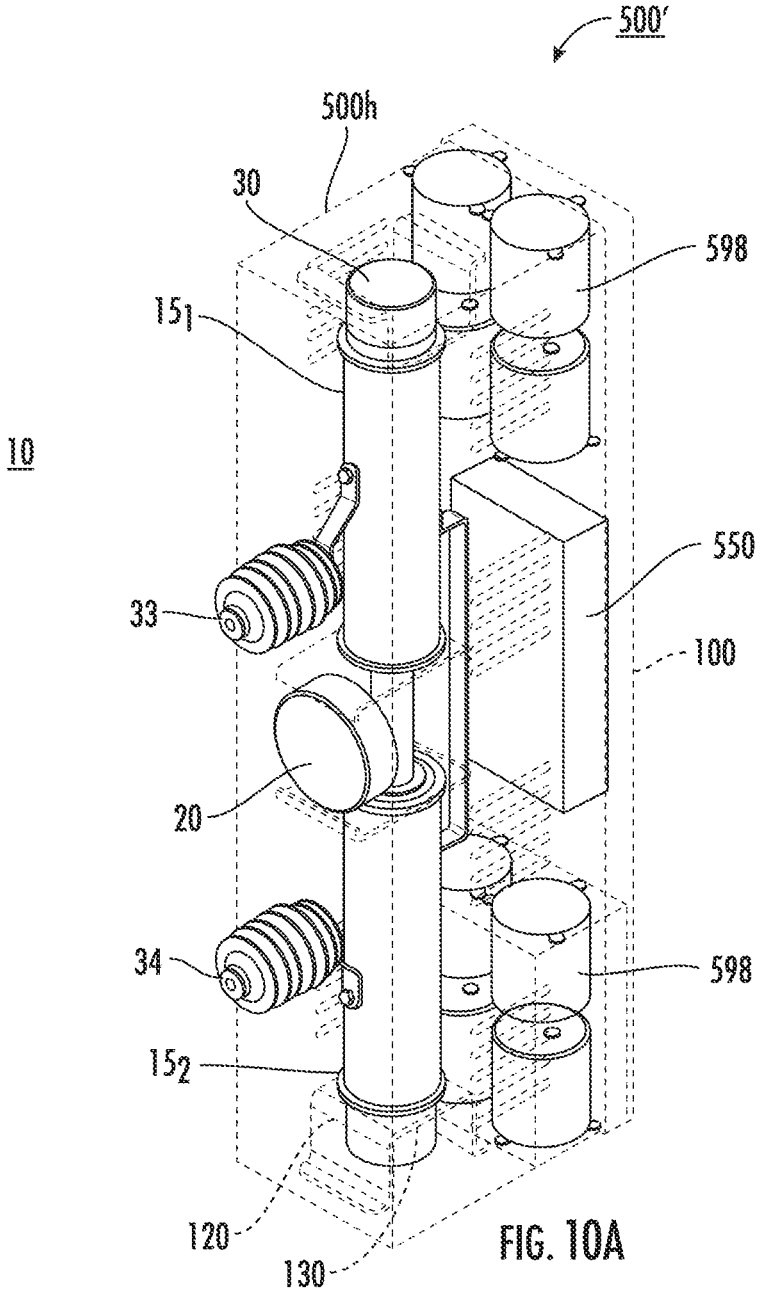
FIGS. 10A-10C are side perspective views of another example device comprising a disconnect switch assembly according to embodiments of the present invention.
Figure 10C:
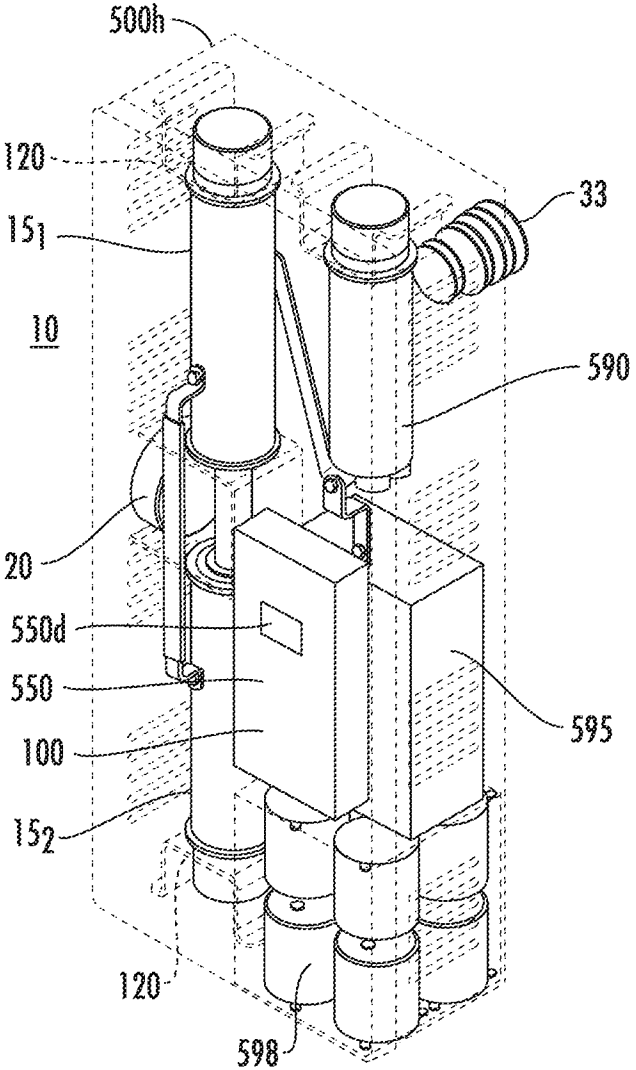
Figure 10B:
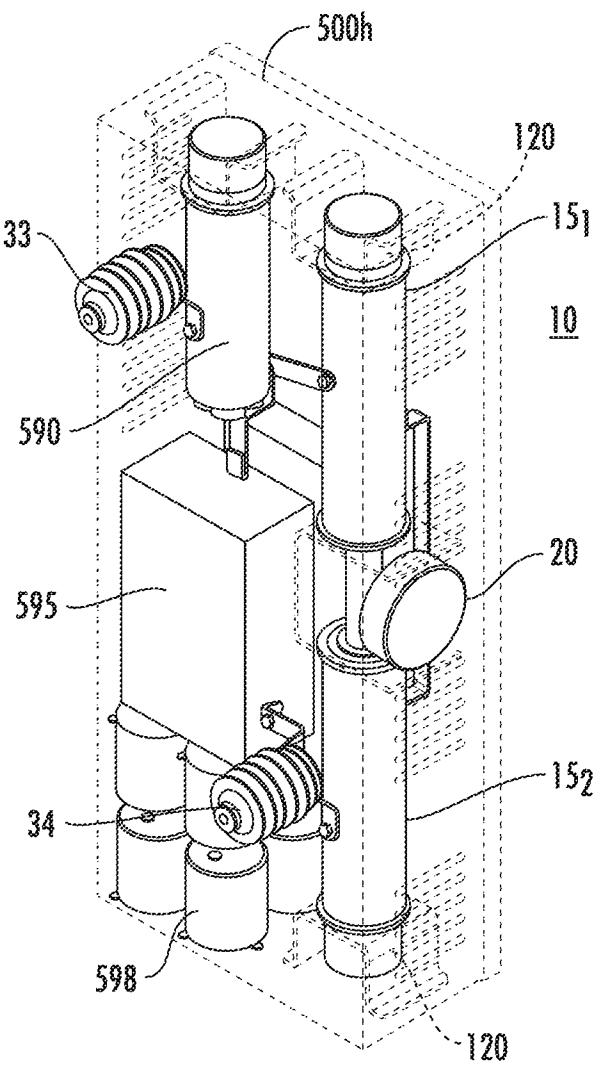

FIGS. 10A-10C illustrate another example of a circuit interrupter 500' comprising at least one disconnect assembly 10 with the first and second disconnect switches $\mathbf{15}_1$, $\mathbf{15}_2$ and the first, second and third actuators 20, 30, 130. The circuit interrupter 500' has a housing 500*h* which encloses the disconnect switch assembly 10. The device 500' can include externally accessible terminals 33, 34 that extend out of the housing 500*h* for external connection and a control unit 550 that can include a display 550*d*. The control unit 550 can include the controller 100 that controls the actuators 20, 30, 130 (FIG. 2A). The device 500' can include an isolation switch 590 and a power electronic switch 595. As shown, the device 500' can also include at least one capacitor bank 598 (shown as two longitudinally spaced apart sets) for storing energy. The isolation switch 590 can be held parallel and laterally spaced apart from but adjacent one of the disconnect switches 15.

In contemporary AC circuit breakers, the opening and closing times are in the range of 30-85 ms, out of which an actual arcing time is ½ to 1 cycle of the AC current, i.e., 16 ms in the U.S. with 60 Hz frequency or 20 ms in other countries of the world. Embodiments of the present invention provide the initial interruption position (FIGS. 4B, 6B) in under 3 ms, more typically in 0.5 ms-1.5 ms, such as 1 ms to 2 ms or less, followed by an isolation position (FIGS. 4C, 6C) in 20-50 ms, more typically 20-40 ms or 20-30 ms.

Figure 8:
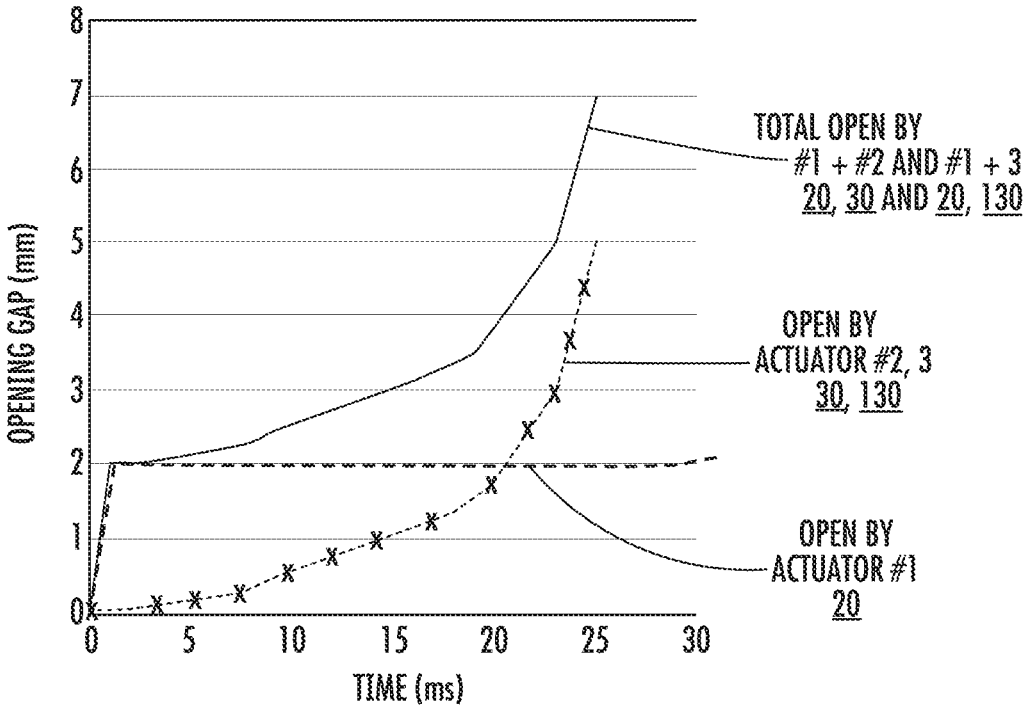
FIG. 8 is a graph of an example opening operation of distance (mm) versus time (ms) according to embodiments of the present invention.

FIG. 8 illustrates a timing graph millimeter versus milliseconds (mm vs. ms) of an example opening operation. The first actuator 20 provides an opening gap g1 for each disconnect switch $\mathbf{15}_1$, $\mathbf{15}_2$ (FIGS. 4B, 6B) of about 2 mm in about 2 ms or less, then stops and does not provide further motive force for opening. The second actuator 30 and the third actuator 130 (lowest line marked with the "x" delineation) can initiate opening movement (in an opposing direction as the first actuator 20) at the same time as the first actuator 20 or within 2 ms thereof and each continues to operate to provide an opening gap distance of about 5 mm. In total, the first and second actuators 20, 30 and the first and third actuators 20, 130 define pairs of cooperating actuators to provide a respective cumulative opening gap g2 (FIGS. 4C, 6C) distance, which can be about 7 mm.

Thus, in some embodiments, the first, second and third actuators 20, 30, 130, respectively, receive an open command simultaneously and can respond simultaneously. The first actuator 20 moves faster and reaches a 2 mm contact (initial interruption) gap in 1 ms (or less) in one direction, then stops at 2 mm. The second actuator 30 and the third actuator 130 move slower than the first actuator 20 and open the contact gap to 5 mm in 25 ms in an opposing direction, then it stops there. The first and second actuators 20, 30 and the first and third actuators, 20, 130 can each provide a total contact opening gap (isolation gap) of 7 mm in 25 ms in this example.

Referring again to FIG. 2, the controller 100 can include at least one processor (i.e., digital signal processor) 100. The controller 100 can be onboard the circuit interrupter 500 (FIG. 9) and can be in communication with sensors and/or current transformers that can engage stabs of switchgear to measure current occurring during an opening, closing or shorting event, for example.

Figure 7:
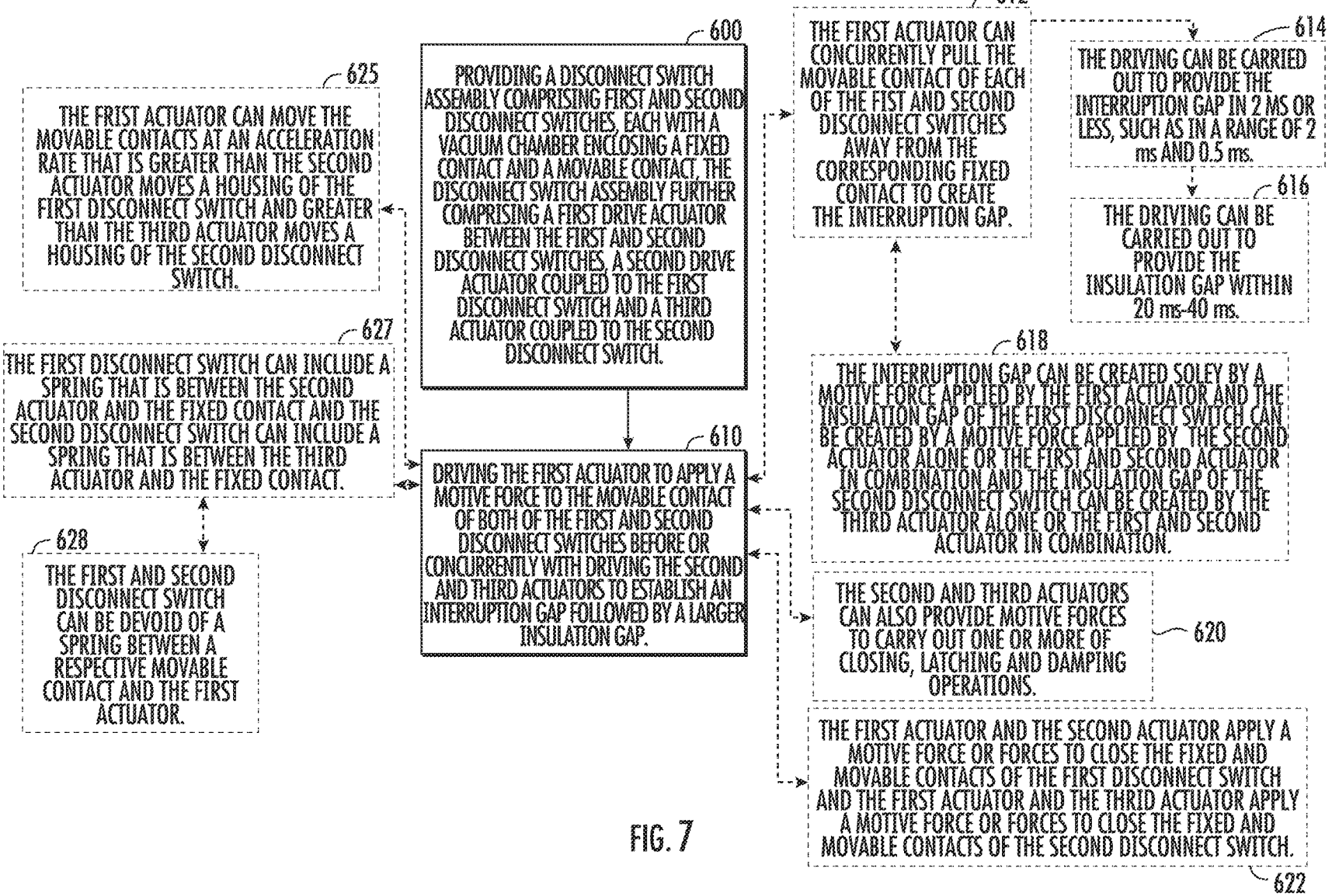
FIG. 7 is a flow chart of example actions that can be used to operate a disconnect switch according to embodiments of the present invention.

FIG. 7 is an example flow chart of operations that can be used for operating a disconnect switch according to embodiments of the present invention. A disconnect switch assembly is provided, The assembly comprising first and second disconnect switches, each with a vacuum chamber enclosing a fixed contact and a movable contact, the disconnect switch assembly further comprising a first drive actuator between the first and second disconnect switches, a second drive actuator coupled to the first disconnect switch and a third actuator coupled to the second disconnect switch (block 600). The first actuator is driven to apply a motive force to the movable contact of both of the first and second disconnect switches before or concurrently with driving the second and third actuators to establish an interruption gap followed by a larger insulation gap (block 610).

The first actuator can concurrently pull the movable contact of each of the first and second disconnect switches away from a corresponding fixed contact to create the (initial) interruption gap (block 612).

The driving of the first actuator can be carried out to provide the interruption gap of the first and second disconnect switches in 3 ms or less, such as in a range of 2 ms and 0.5 ms (block 614).

The driving of the first and second actuators and the first and third actuators can be carried out to provide the insulation gap within about 20 ms-40 ms (block 616).

The interruption gap of each of the first and second disconnect switches can be created solely by the driving movement of the first actuator.

The interruption gap can be created solely by a motive force applied by the first actuator and the insulation gap of the first disconnect switch can be created by a motive force applied by the second actuator alone or the first and second actuator in combination and the insulation gap of the second disconnect switch can be created by the third actuator alone or the first and second actuator in combination (block 618)

The second and third actuators can also provide motive forces to carry out one or more of closing, latching and damping operations (block 620).

The first actuator can also provide a motive force for one or more of closing, latching and damping and the closing and latching can be applied concurrently with the closing and latching of the second actuator and the third actuator.

The first actuator and the second actuator apply a motive force or forces to close the fixed and movable contacts of the first disconnect switch and the first actuator and the third actuator apply a motive force or forces to close the fixed and movable contacts of the second disconnect switch (block 622).

The first actuator can move the movable contacts at an acceleration rate that is greater than the second actuator moves a housing of the first disconnect switch and greater than the third actuator moves a housing of the second disconnect switch (block 625).

The first disconnect switch can include a spring that is between the second actuator and the fixed contact and the second disconnect switch can include a spring that is between the third actuator and the fixed contact (block 627).

The first and second disconnect switch can be devoid of a contact spring between the movable contact and the first actuator (block 628).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A disconnect switch assembly, comprising:

a first disconnect switch comprising:

a first housing;

a first fixed main contact in the first housing;

a first movable main contact in the first housing in cooperating alignment with the first fixed main contact;

a second disconnect switch comprising:

a second housing;

a second fixed main contact in the second housing;

a second movable main contact in the second housing in cooperating alignment with the second fixed main contact;

a first actuator coupled to the first movable main contact and to the second movable main contact;

a second actuator coupled to the first housing; and a third actuator coupled to the second housing, wherein, during an opening operation, the second actuator is configured to apply a motive force to the first housing of the first disconnect switch that is in a direction opposing a motive force applied by the first actuator to the first movable main contact, and wherein the third actuator is configured to apply a motive force to the second housing that is in a direction opposing a motive force applied by the first actuator to the second movable main contact.

2. The disconnect switch assembly of claim 1, wherein the first actuator resides between the first and second housings.

3. The disconnect switch assembly of claim 2, wherein the first actuator comprises first and second drive arms that extend in opposing directions, and wherein the first drive arm is coupled to the first movable main contact to thereby couple the first actuator to the first movable main contact and the second drive arm is coupled to the second movable main contact to thereby couple the first actuator to the second movable main contact.

4. The disconnect switch assembly of claim 3, wherein the first housing and the second housing each comprise opposing first and second end portions, and wherein the second end portions are in-line (axially aligned) and face each other across the first actuator.

5. The disconnect switch assembly of claim 4, wherein, during the opening operation, the first arm retracts away from the second end portion of the first housing and the second arm concurrently retracts away from the second end portion of the second housing to place the first and second movable contacts at a respective initial interruption gap position, and wherein during the opening operation, the second actuator pulls the first housing away from the first actuator while the third actuator pulls the second housing away from the first actuator to place the first and second movable contacts at a respective electrical isolation gap position.

6. The disconnect switch assembly of claim 5, further comprising:

a first vacuum chamber provided by the first housing, wherein the first fixed main contact and the first movable main contact reside in the first vacuum chamber;

a second vacuum chamber provided by the second housing, wherein the second fixed main contact and the second movable main contact reside in the second vacuum chamber;

a first drive rod coupled to the second actuator and extending into the first end portion of the first housing; and a second drive rod coupled to the third actuator and extending into the first end portion of the second housing.

7. The disconnect switch assembly of claim 1, wherein the first actuator is a piezoelectric actuator.

8. The disconnect switch assembly of claim 1, wherein the first actuator is a Thomson coil actuator.

9. The disconnect switch assembly of claim 1, further comprising a first contact spring coupled to the first housing and a second contact spring coupled to the second housing, wherein, in operation, during a closed state of the first disconnect switch and the second disconnect switch, the first contact spring applies a closing force toward the first movable main contact and the second contact spring applies a closing force toward the second movable main contact.

10. The disconnect switch assembly of claim 1, wherein the first and second disconnect switch each has a fully open position for an electrical isolation state and a closed position associated with a fully closed state allowing electrical conduction, wherein, in the fully open position, the first fixed and first movable main contacts are spaced apart and the second fixed and the second movable main contacts are spaced apart, wherein, in the closed position, each of the first and second fixed main contacts abut a corresponding first and second movable main contact, and wherein the second actuator is configured to apply a latching force to latch the first movable main contact and the first fixed main contact together in the closed position and/or apart in the fully open position while the third actuator is configured to apply a latching force to latch the second movable main contact and the second fixed main contact together in the closed position and/or apart in the fully open position.

11. The disconnect switch assembly of claim 1, wherein the first and second disconnect switch each has a fully open position for an electrical isolation state and a closed position associated with a fully closed state allowing electrical conduction, wherein, in the fully open position, the first fixed main contact and the first movable main contact are spaced apart and the second fixed main contact and the second movable main contact are spaced apart, wherein, in the closed position, the first fixed and first movable main contacts abut and the second fixed and second movable main contacts abut, and wherein the first actuator is configured to concurrently apply a latching force to latch both the first movable and the first fixed main contact and the second movable and the second fixed main contact (a) together in the closed position and/or (b) apart in the fully open position.

12. The disconnect switch assembly of claim 1, further comprising a controller in communication with the first actuator, the second actuator and the third actuator, and wherein the controller directs the first actuator to actuate to concurrently apply a motive force to the first and second movable main contacts and direct the second and third actuators to actuate to apply a motive force to the first and second housings in opposing directions during the opening operation.

13. The disconnect switch assembly of claim 1, further comprising:

a first coupler assembly that directly or indirectly attaches the second actuator to the first housing; and a second coupler assembly that directly or indirectly attaches the third actuator to the second housing.

14. The disconnect switch assembly of claim 13, wherein the first and the second coupler assembly each comprise a respective contact spring chamber that holds a contact spring, and wherein the second actuator comprises a first coupler attachment member that is configured to compress the contact spring to apply a closing and/or latching force against the first housing in a direction toward the first movable main contact while the third actuator comprises a second coupler attachment member that is configured to compress the contact spring to apply a closing and/or latching force against the second housing in a direction toward the second movable main contact.

15. The disconnect switch assembly of claim 1, wherein the first actuator concurrently provides a respective motive force in opposing first and second directions to move the first and second movable main contacts, respectively, to an initial interruption gap position, wherein only the second actuator provides a motive force to the first housing to move the first housing in the second direction opposing the first direction to move the first fixed main contact away from the first movable main contact, wherein only the third actuator provides a motive force to the second housing to move the second housing in the first direction opposing the second direction to move the second fixed main contact away from the second movable main contact whereby the first fixed and first movable main contacts and the second fixed and second movable main contacts are spaced apart in an insulation gap position, and wherein there is a greater spacing between the first fixed and first movable main contacts and the second fixed and the second movable main contacts in the insulation gap position than in the initial interruption gap position.

16. The disconnect switch assembly of claim 1, wherein, during an opening operation, the second actuator moves a first vacuum interrupter body of the first housing away from the first actuator while the third actuator moves a second vacuum interrupter body of the second housing away from the first actuator, wherein the first disconnect switch comprises a first gap space between an end of the first vacuum interrupter body facing the second actuator and an adjacent first support member, wherein the second disconnect switch comprises a second gap space between an end of the second vacuum interrupter body facing the third actuator and an adjacent second support member, and wherein when the first and second disconnect switches are in a fully closed state and in an initial open state, the first and second gap spaces are greater than when in a fully open state.

17. The disconnect switch assembly of claim 1, further comprising a first support member residing between the first housing and the second actuator and a second support member residing between the second housing and the third actuator, and wherein when the first and second disconnect switches are in a fully closed state and an initial open state, a gap space between the first housing and the first support member and between the second housing and the second support member is less than when in a fully open state.

18. The disconnect switch assembly of claim 17, wherein, when in the fully closed state, the gap space is in a range of 5-20 mm.

19. The disconnect switch assembly of claim 1, wherein, during the opening operation, the first actuator moves the first and second movable main contacts at a first velocity to an initial interruption gap position away from respective first and second fixed main contacts that is in a range of about 1-3 mm, wherein the second actuator moves the first housing at a second velocity and the third actuator moves the second housing at a third velocity, wherein the second velocity and the third velocity are less than the first velocity for a time sufficient to move a distance that is in a range of about 3 mm-15 mm whereby the first disconnect switch has a first isolation gap between the first fixed and first movable main contacts that is in a range of about 5 mm-15 mm and the second disconnect switch has a second isolation gap between the second fixed and second movable main contacts that is in a range of about 5 mm-15 mm.

20. The disconnect switch assembly of claim 19, wherein the first actuator is configured to apply respective motive forces to concurrently move the first and second movable main contacts away from the first and second fixed main contacts, respectively, to provide the initial interruption gap position in less than 3 ms, then stops applying the motive force, and wherein the second actuator is configured to apply a motive force to move the first housing and the third actuator is configured to apply a motive force to the second housing to a full opening travel distance in 20-50 ms thereby providing the first and second isolation gaps.

21. A method of operating a disconnect switch assembly, comprising:

providing the disconnect switch assembly, wherein the disconnect switch assembly comprises a first vacuum interrupter disconnect switch, a second vacuum interrupter disconnect switch and a first drive actuator therebetween, each of the first and second vacuum interrupter disconnect switches comprising a respective vacuum chamber enclosing a fixed contact and a movable contact; and actuating the first drive actuator to concurrently apply a first motive force in a first direction to the movable contact in the first vacuum interrupter disconnect switch and a second motive force in an opposing second direction to the movable contact in the second vacuum interrupter disconnect switch to thereby move the movable contacts to an initial opening position, wherein the disconnect switch assembly further comprises a second drive actuator coupled to the first vacuum interrupter disconnect switch and a third drive actuator coupled to the second vacuum interrupter disconnect switch, the method further comprising:

before or concurrently with actuating the first drive actuator to apply the first and second motive forces, directing the second drive actuator to apply a motive force to the first vacuum interrupter disconnect switch in a direction opposing the first motive force applied by the first actuator while directing the third drive actuator to apply a motive force to the second vacuum interrupter disconnect switch in a direction opposing the second motive force applied by the first actuator during an opening operation to thereby define a separation gap between respective fixed and movable contacts.

22. The method of claim 21, further comprising actuating the first drive actuator to concurrently apply a closing motive force to each of the movable contacts of the first and second vacuum interrupter disconnect switches in opposing closing directions before or concurrently with actuating the second drive actuator and the third drive actuator to establish a closed state of the first and second vacuum interrupter disconnect switches with respective fixed and main contacts abutting each other.

23. The method of claim 21, further comprising latching the fixed and movable contacts in an open and/or closed position using the second and third actuators.

24. The method of claim 21, wherein, during an opening operation, actuating the first drive actuator is carried out to concurrently pull the movable contact of the first and second vacuum interrupter disconnect switches away from a corresponding fixed contact using the first and second motive forces applied by the first drive actuator to force each movable contact away from the corresponding fixed contact to an initial interruption gap, then the first drive actuator ceases applying any motive force, wherein the second and third drive actuators apply respective motive forces for a longer duration than the first drive actuator applies the first and second motive forces to move the vacuum chamber enclosing the fixed and movable contacts away from the first drive actuator to increase a separation distance between the movable and fixed contacts from the initial interruption gap and thereby create an insulation gap.

* * * * *